US007930910B2

(12) United States Patent
Chang

(10) Patent No.: US 7,930,910 B2
(45) Date of Patent: Apr. 26, 2011

(54) DRUM TYPE WASHING MACHINE

(75) Inventor: Jae-Won Chang, Gunpo (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/639,872

(22) Filed: Dec. 16, 2009

(65) Prior Publication Data

US 2010/0089101 A1 Apr. 15, 2010

Related U.S. Application Data

(63) Continuation of application No. 12/267,457, filed on Nov. 7, 2008, which is a continuation of application No. 10/461,451, filed on Jun. 16, 2003, now Pat. No. 7,533,548.

(30) Foreign Application Priority Data

Dec. 27, 2002 (KR) ..... 2002-85521

(51) Int. Cl.
*D06F 37/22* (2006.01)

(52) U.S. Cl. ..... 68/24; 68/58; 68/140

(58) Field of Classification Search ..... 68/24, 58, 68/140

See application file for complete search history.

(56) References Cited

U.S. PATENT DOCUMENTS

| | | | | |
|---|---|---|---|---|
| 912,038 | A | 2/1909 | Seifert | |
| 1,077,043 | A | 10/1913 | Darrow | |
| 1,470,245 | A | 10/1923 | Slider | |
| 1,611,865 | A | 12/1926 | Ahlm | |
| 1,611,895 | A | 12/1926 | Dienner | |
| 1,787,427 | A | 1/1931 | Eckhard | |
| 2,089,066 | A | 8/1937 | Morrill | 248/26 |
| 2,096,649 | A | 10/1937 | Rasanen | |
| 2,152,458 | A | 3/1939 | Bergman | 172/36 |
| 2,153,418 | A | 4/1939 | Haberstump | 286/5 |
| 2,165,884 | A | 7/1939 | Chamberlin et al. | 8/159 |
| 2,191,607 | A | 2/1940 | Chamberlin et al. | |
| 2,230,345 | A | 2/1941 | Bradbury | |
| 2,278,911 | A | 4/1942 | Breckenridge | |
| 2,296,257 | A | 9/1942 | Breckenridge | |
| 2,296,261 | A | 9/1942 | Breckenridge et al. | |
| 2,296,267 | A | 9/1942 | Baird | |

(Continued)

FOREIGN PATENT DOCUMENTS

CN 1332816 A 1/2002

(Continued)

OTHER PUBLICATIONS

European Search Report dated Feb. 3, 2010 for Application No. 09178918.0.

(Continued)

*Primary Examiner* — Frankie L Stinson
(74) *Attorney, Agent, or Firm* — KED & Associates, LLP

(57) ABSTRACT

A drum type washing machine is provided. The drum type washing machine may include a cabinet, a tub fixed to an inner side of the cabinet, a drum rotatably arranged in the tub, and a driving motor positioned at a rear side of the drum for generating a driving force that rotates the drum. The washing machine may also include a supporting plate to rotatably support a rotational shaft extending between the motor and the drum, and a plurality of supporters connected between the supporting plate and the cabinet. Such an arrangement may increase washing capacity by increasing a diameter of the drum without increasing an external size of the cabinet.

21 Claims, 9 Drawing Sheets

U.S. PATENT DOCUMENTS 2,323,765 A 7/1943 Haberstump
2,331,897 A 10/1943 Dyer
2,356,816 A 8/1944 Breckenridge et al.
2,356,818 A 8/1944 Bruckman
2,389,774 A 11/1945 Haberstump
2,408,509 A 10/1946 Clark
2,434,476 A 1/1948 Wales
2,498,181 A 2/1950 Reiter
2,509,516 A 5/1950 Murphy
2,510,836 A 6/1950 Russell et al.
2,521,578 A 9/1950 Haberstump ..... 68/19
2,526,002 A 10/1950 Brotman
2,526,048 A 10/1950 Russell
2,526,444 A * 10/1950 Woodson ..... 68/12.01
2,527,239 A 10/1950 Woodson
2,541,166 A 2/1951 Leef
2,542,509 A 2/1951 Goriup
2,556,490 A * 6/1951 Chamberlin ..... 8/159
2,565,604 A 8/1951 Geiger
2,579,472 A 12/1951 Chamberlin et al.
2,579,836 A 12/1951 Lee et al. ..... 260/26
2,589,284 A 3/1952 O'Neil
2,593,752 A 4/1952 Haberstump
2,615,320 A 10/1952 Belaieff
2,620,070 A * 12/1952 Dodge ..... 210/365
2,644,326 A * 7/1953 Worst ..... 68/23.5
2,652,708 A 9/1953 Rimsha et al.
2,656,700 A 10/1953 Smith
2,711,297 A 6/1955 Thiele ..... 248/568
2,717,135 A 9/1955 Douglas
2,757,531 A 8/1956 Fox
2,758,685 A 8/1956 Sisson
2,774,621 A 12/1956 Kilbourne
2,785,557 A 3/1957 Stilwell
2,836,046 A 5/1958 Smith ..... 68/24
2,843,314 A 7/1958 Hansen ..... 230/232
2,873,599 A 2/1959 Buechler
2,882,706 A 4/1959 Brucken
2,893,135 A 7/1959 Smith
2,895,319 A * 7/1959 Rochefort ..... 68/3 R
2,908,871 A 10/1959 McKay
2,930,217 A 3/1960 Rehmke
2,937,516 A 5/1960 Czaika
2,957,330 A 10/1960 Cline
2,972,877 A * 2/1961 Platt ..... 68/18 F
2,984,094 A 5/1961 Belaieff
2,986,914 A 6/1961 Brucken
2,990,706 A 7/1961 Bochan
2,995,023 A * 8/1961 Douglas ..... 68/131
2,987,189 A 9/1961 Evjen
3,048,026 A * 8/1962 Bochan et al. ..... 68/12.09
3,066,522 A 12/1962 Steinmüller ..... 68/23.2
3,073,668 A 1/1963 Rothenberger
3,089,326 A 5/1963 Belaieff
3,098,581 A 7/1963 Marsillo
3,153,951 A 10/1964 Whelan ..... 74/665
3,178,916 A 4/1965 Belaieff et al.
3,197,983 A 8/1965 Ilmer et al.
3,206,267 A 9/1965 Gruner et al.
3,257,830 A 6/1966 Shelton ..... 68/133
3,273,361 A 9/1966 Smith
3,333,444 A 8/1967 Bochan ..... 68/208
3,356,222 A 12/1967 Belaieff et al.
3,389,881 A 6/1968 Stelwagen ..... 248/18
3,391,469 A 7/1968 Reeder
3,459,461 A 8/1969 Bannon, Jr.
3,477,259 A 11/1969 Barnish et al.
3,509,742 A 5/1970 Bauer
3,531,954 A 10/1970 Krupsky
3,927,542 A 12/1975 De Hedouville et al.
4,114,406 A 9/1978 Horowitz et al.
4,295,387 A 10/1981 Zhivotov et al.
4,412,390 A 11/1983 Grant
4,446,706 A 5/1984 Hartwig
4,498,181 A 2/1985 Menown et al. ..... 372/38
4,618,193 A 10/1986 Cuthbert et al.
4,819,460 A 4/1989 Obradovic ..... 68/23.7
4,989,684 A 2/1991 Conaway
5,038,586 A 8/1991 Nukaga et al.
5,080,204 A 1/1992 Bauer et al.
5,199,690 A 4/1993 Marshall
5,209,458 A 5/1993 Eubank et al.
5,230,229 A 7/1993 Stadelmann et al.
5,267,456 A 12/1993 Nukaga et al.
5,280,660 A 1/1994 Pellerin et al. ..... 8/158
5,526,657 A 6/1996 Johnson
5,657,649 A 8/1997 Lim et al.
5,711,170 A 1/1998 Johnson
5,711,171 A 1/1998 Uhlin et al.
5,768,730 A 6/1998 Matsumoto et al.
5,870,905 A 2/1999 Imamura et al.
5,913,951 A 6/1999 Herr et al. ..... 81/158
5,961,105 A 10/1999 Ehmsberger et al.
5,979,195 A 11/1999 Bestell et al.
6,032,494 A 3/2000 Tanigawa et al.
6,122,843 A 9/2000 Noguchi et al.
6,148,647 A 11/2000 Kabeya et al.
6,343,492 B1 2/2002 Seagar et al.
6,363,756 B1 4/2002 Seagar et al.
6,460,382 B1 10/2002 Kim et al. ..... 68/140
6,474,114 B1 11/2002 Ito et al.
6,477,867 B1 11/2002 Collecutt et al.
6,481,035 B2 11/2002 Seagar et al.
6,510,715 B1 1/2003 Simsek et al.
6,510,716 B1 1/2003 Kim et al.
6,516,638 B1 2/2003 Myerscough
6,539,753 B1 4/2003 Ito et al.
6,557,383 B1 5/2003 Ito et al.
6,564,594 B1 5/2003 Ito et al. ..... 68/24
6,578,225 B2 6/2003 Jönsson ..... 8/159
6,578,391 B2 6/2003 Seagar et al.
6,626,014 B2 9/2003 Heyder et al.
6,981,395 B2 1/2006 Ryu et al.
7,073,356 B2 7/2006 Nakamura et al. ..... 68/12.26
7,334,799 B2 2/2008 O'Hara ..... 277/361
7,841,220 B2 11/2010 Lim et al.
2002/0166349 A1 11/2002 Lim et al. ..... 68/23.7
2003/0056302 A1 3/2003 Broker et al.
2004/0025544 A1 2/2004 Kim et al. ..... 68/3
2004/0031295 A1 2/2004 Choi
2004/0035155 A1 2/2004 Yoon
2004/0123631 A1 7/2004 Chang ..... 68/23.1
2004/0129035 A1 7/2004 Chang ..... 68/23
2004/0163428 A1 8/2004 Kim et al. ..... 68/140
2004/0237603 A1 12/2004 Kim et al. ..... 68/15
2004/0244121 A1 12/2004 Lim et al.
2004/0244168 A1 12/2004 Lee
2005/0028564 A1 2/2005 Lee et al. ..... 68/24
2005/0188472 A1 9/2005 Park et al. ..... 8/158
2006/0010612 A1 1/2006 Kim et al. ..... 8/158
2006/0011429 A1 1/2006 Park et al. ..... 188/322.13
2006/0016228 A1 1/2006 Chang et al. ..... 68/23.1
2006/0254321 A1 11/2006 Lim et al.
2007/0125135 A1 6/2007 Kim et al. ..... 69/140
2007/0227200 A1 10/2007 Kim et al. ..... 68/140

FOREIGN PATENT DOCUMENTS

CN 1511997 A 7/2004
CN 1515732 A 7/2004
DE 1 095 778 12/1960
DE 1 113 439 9/1961
DE 19 12 481 A1 3/1965
DE 24 01 888 7/1975
DE 24 54 489 5/1976
DE 26 33 604 2/1978
DE 27 32 684 2/1978
DE 27 46 989 A1 4/1978
DE 31 09 641 A1 2/1982
DE 31 34633 A1 8/1982
DE 34 37 835 A1 5/1985
DE 38 11 583 A1 10/1989
DE 39 07 258 A1 10/1989
DE 39 34 434 A1 4/1992
DE 42 39 504 A1 5/1994
DE 43 10 594 A1 10/1994
DE 43 30 079 A1 3/1995
DE 199 61 780 7/2001

| | | | |
|---|---|---|---|
| EP | 0 124 939 | | 11/1984 |
| EP | 0 132 805 | | 2/1985 |
| EP | 0 272 949 | | 6/1988 |
| EP | 0 371 926 | A1 | 6/1990 |
| EP | 0 405 068 | A1 | 1/1991 |
| EP | 0 716 177 | B1 | 6/1996 |
| EP | 0 750 064 | A1 | 12/1996 |
| EP | 0 969 134 | A1 | 1/2000 |
| EP | 0 725 179 | B1 | 7/2000 |
| EP | 1 055 765 | A1 | 11/2000 |
| EP | 1 079 014 | B1 | 2/2001 |
| EP | 1 094 239 | B1 | 4/2001 |
| EP | 1 201 810 | | 5/2002 |
| EP | 1 386 996 | B1 | 2/2004 |
| EP | 1 433 890 | B1 | 6/2004 |
| EP | 1 433 891 | A2 | 6/2004 |
| EP | 1 505 191 | A1 | 2/2005 |
| EP | 1 605 088 | A2 | 12/2005 |
| EP | 1 688 531 | A1 | 8/2006 |
| GB | 646582 | | 11/1950 |
| GB | 1120431 | | 7/1968 |
| GB | 2 096 649 | A | 10/1982 |
| GB | 2 157 326 | A | 10/1985 |
| GB | 2 202 867 | A | 10/1988 |
| GB | 2 360 296 | | 9/2001 |
| JP | 48-64179 | | 8/1973 |
| JP | 54-028470 | * | 3/1979 |
| JP | 57-43792 | A | 3/1982 |
| JP | 56-116987 | A | 9/1982 |
| JP | 59-211496 | A | 11/1984 |
| JP | 60-190998 | | 9/1985 |
| JP | 3-88479 | U | 9/1991 |
| JP | 4-92697 | | 3/1992 |
| JP | 04-236988 | A | 8/1992 |
| JP | 04-240488 | | 8/1992 |
| JP | 04-325196 | | 11/1992 |
| JP | 4-371194 | A | 12/1992 |
| JP | 05-084388 | | 4/1993 |
| JP | 05-220293 | A | 8/1993 |
| JP | 06-079087 | A | 3/1994 |
| JP | 09-182368 | | 7/1997 |
| JP | 09-182370 | A | 7/1997 |
| JP | 10201993 | | 8/1998 |
| JP | 11-76680 | | 3/1999 |
| JP | 2000-262796 | A | 9/2000 |
| JP | 2000-334194 | A | 12/2000 |
| JP | 2002-153695 | | 5/2002 |
| JP | 2002-346281 | A | 12/2002 |
| JP | 2003-079995 | | 3/2003 |
| JP | 2003-230792 | A | 8/2003 |
| JP | 2004-513721 | | 5/2004 |
| JP | 2004-188204 | | 7/2004 |
| JP | 2005-198698 | | 7/2005 |
| JP | 2006-026408 | | 2/2006 |
| KR | 10-1999-0066050 | A | 8/1999 |
| KR | 10-1999-0079731 | A | 11/1999 |
| KR | 10-2001-0009545 | A | 2/2001 |
| KR | 10-2004-0011307 | A | 2/2004 |
| KR | 10-2004-0047223 | A | 6/2004 |
| KR | 2004-0058999 | | 7/2004 |
| SU | 1181112 | A | 9/1986 |
| SU | 1663074 | A1 | 7/1991 |
| SU | 1 703 740 | | 1/1992 |
| WO | WO 98/29595 | | 7/1998 |
| WO | WO 99/35320 | | 7/1999 |

OTHER PUBLICATIONS

Japanese Office Action dated Dec. 18, 2009 for Application No. 2004-000478.

Office Action dated Sep. 21, 2009 in U.S. Appl. No. 12/267,457.

Final Office Action dated Mar. 5, 2010 issued in U.S. Appl. No. 12/267,457.

U.S. Office Action dated Dec. 30, 2005 issued in U.S. Appl. No. 10/461,451.

U.S. Final Office Action dated Aug. 14, 2006 issued in U.S. Appl. No. 10/461,451.

U.S. Final Office Action dated Dec. 13, 2006 issued in U.S. Appl. No. 10/461,451.

U.S. Office Action dated Jan. 5, 2007 issued in U.S. Appl. No. 11/475,885.

U.S. Office Action dated Apr. 27, 2007 issued in U.S. Appl. No. 10/461,451.

U.S. Office Action dated Jun. 8, 2007 issued in U.S. Appl. No. 11/470,704.

U.S. Final Office Action dated Jul. 17, 2007 issued in U.S. Appl. No. 11/475,885.

U.S. Office Action dated Nov. 19, 2007 issued in U.S. Appl. No. 10/461,451.

U.S. Office Action dated Nov. 30, 2007 issued in U.S. Appl. No. 11/470,704.

U.S. Office Action dated Apr. 1, 2008 issued in U.S. Appl. No. 11/475,885.

U.S. Final Office Action dated May 15, 2008 issued in U.S. Appl. No. 11/470,704.

U.S. Final Office Action dated Jun. 16, 2008 issued in U.S. Appl. No. 10/461,451.

U.S. Office Action dated Sep. 5, 2008 issued in U.S. Appl. No. 11/165,332.

U.S. Office Action dated Sep. 11, 2008 issued in U.S. Appl. No. 11/470,704.

U.S. Final Office Action dated Feb. 25, 2009 issued in U.S. Appl. No. 11/165,332.

U.S. Office Action dated Feb. 25, 2009 issued in U.S. Appl. No. 12/198,269.

Japanese Office Action dated Mar. 2, 2009 issued in Application No. 2004-000478.

U.S. Office Action dated Oct. 15, 2009 issued in U.S. Appl. No. 11/529,759.

U.S. Office Action dated Oct. 28, 2009 issued in U.S. Appl. No. 12/230,031.

U.S. Final Office Action dated Nov. 14, 2009 issued in U.S. Appl. No. 12/198,269.

U.S. Office Action dated Feb. 2, 2010 issued in U.S. Appl. No. 12/198,269.

Chinese Office Action dated Mar. 8, 2010 issued in Application No. 200610142200.6.

U.S. Final Office Action dated Mar. 19, 2010 issued in U.S. Appl. No. 11/529,759.

Notice of Opposition dated May 7, 2010 filed in the European Patent Office for European Patent Application No. 05013603.5 (Publication No. EP 1 619 286 B1).

U.S. Final Office Action dated May 14, 2010 issued in U.S. Appl. No. 12/230,031.

European Patent Office 0 124 939 May 1984.

European Patent Office 0 272 949 Nov. 1987.

European Patent Office 0 750 064 Jun. 1995.

European Patent Office 0 405 068 Jan. 1991.

Japanese Office Action issued in JP Application No. 2005-204374 dated Jul. 28, 2010.

Japanese Office Action issued in JP Application No. 2006-235745 dated Aug. 3, 2010.

Notice of Opposition and Opposition Brief filed in EP Application No. 03013411.8 dated Sep. 29, 2010 (Publication No. EP 1 433 890 B1) (full German text and English translation).

U.S. Office Action issued in U.S. Appl. No. 12/797,758 dated Oct. 28, 2010.

U.S. Office Action issued in U.S. Appl. No. 12/639,859 dated Dec. 9, 2010.

U.S. Office Action issued in U.S. Appl. No. 12/940,138 dated Dec. 16, 2010.

U.S. Office Action issued in U.S. Appl. No. 12/639,894 dated Dec. 23, 2010.

* cited by examiner

DRUM TYPE WASHING MACHINE

The present application is a 37 C.F.R. §1.53(b) continuation of U.S. patent application Ser. No. 12/267,457 filed Nov. 7, 2008, currently pending, which is a 37 C.F.R. §1.53(b) continuation of U.S. patent application Ser. No. 10/461,451 filed Jun. 16, 2003, now U.S. Pat. No. 7,533,548 B2, which claims priority to Korean Patent Application No. 85521/2002, filed Dec. 27, 2002, the entire contents of which are hereby incorporated by reference herein.

BACKGROUND OF THE INVENTION

1. Field of the Invention

The present invention relates to a drum type washing machine, and more particularly, to a drum type washing machine which can maximize a capacity of a drum without changing an entire size of a washing machine.

2. Description of the Related Art

FIG. 1 is a side sectional view showing a drum type washing machine in accordance with the conventional art, FIG. 2 is a front sectional view showing the drum type washing machine in accordance with the conventional art.

The conventional drum type washing machine comprises: a cabinet 102 for forming an appearance; a tub 104 arranged in the cabinet 102 for storing washing water; a drum 106 rotatably arranged in the tub 104 for washing and dehydrating laundry; and a driving motor 110 positioned at a rear side of the tub 104 and connected to the drum 106 by a driving shaft 108 thus for rotating the drum 106.

An inlet 112 for inputting our outputting the laundry is formed at the front side of the cabinet 102, and a door 114 for opening and closing the inlet 112 is formed at the front side of the inlet 112.

The tub 104 of a cylindrical shape is provided with an opening 116 at the front side thereof thus to be connected to the inlet 112 of the cabinet 102, and a balance weight 118 for maintaining a balance of the tub 104 and reducing vibration are respectively formed at both sides of the tub 104.

Herein, a diameter of the tub 104 is installed to be less than a width of the cabinet 102 by approximately 30~40 mm with consideration of a maximum vibration amount thereof so as to prevent from being contacted to the cabinet 102 at the time of the dehydration.

The drum 106 is a cylindrical shape of which one side is opened so that the laundry can be inputted, and has a diameter installed to be less than that of the tub 104 by approximately 15~20 mm in order to prevent interference with the tub 104 since the drum is rotated in the tub 104.

A plurality of supporting springs 120 are installed between the upper portion of the tub 104 and the upper inner wall of the cabinet 102, and a plurality of dampers 122 are installed between the lower portion of the tub 104 and the lower inner wall of the cabinet 102, thereby supporting the tub 104 with buffering.

A gasket 124 is formed between the inlet 112 of the cabinet 102 and the opening 116 of the tub 104 so as to prevent washing water stored in the tub 104 from being leaked to a space between the tub 104 and the cabinet 102. Also, a supporting plate 126 for mounting the driving motor 110 is installed at the rear side of the tub 104.

The driving motor 110 is fixed to a rear surface of the supporting plate 126, and the driving shaft 108 of the driving motor 110 is fixed to a lower surface of the drum 106, thereby generating a driving force by which the drum 106 is rotated.

In the conventional drum type washing machine, the diameter of the tub 104 is installed to be less than the width of the cabinet 102 with consideration of the maximum vibration amount so as to prevent from being contacted to the cabinet 102, and the diameter of drum 106 is also installed to be less than that of the tub 104 in order to prevent interference with the tub 104 since the drum is rotated in the tub 104. According to this, so as to increase the diameter of the drum 106 which determines a washing capacity, a size of the cabinet 102 has to be increased.

Also, since the gasket 124 for preventing washing water from being leaked is installed between the inlet 112 of the cabinet 102 and the opening 116 of the tub 104, a length of the drum 106 is decreased as the installed length of the gasket 124. According to this, it was difficult to increase the capacity of the drum 106.

SUMMARY OF THE INVENTION

Therefore, an object of the present invention is to provide a drum type washing machine which can increase a washing capacity without changing an entire size thereof, in which a cabinet and a tub is formed integrally and thus a diameter of a drum can be increased without increasing a size of the cabinet.

Another object of the present invention is to provide a drum type washing machine which can increase a washing capacity by increasing a length of a drum without increasing a length of a cabinet, in which the cabinet and a tub are formed integrally and thus a location of a gasket is changed.

To achieve these and other advantages and in accordance with the purpose of the present invention, as embodied and broadly described herein, there is provided a drum type washing machine comprising: a cabinet for forming an appearance; a tub fixed to an inner side of the cabinet and for storing washing water; a drum rotatably arranged in the tub for washing and dehydrating laundry; and a driving motor positioned at the rear side of the drum for generating a driving force by which the drum is rotated.

The tub is a cylindrical shape, and a front surface thereof is fixed to a front inner wall of the cabinet.

Both sides of the tub are fixed to both sides inner wall of the cabinet.

A supporting plate for mounting the driving motor is located at the rear side of the tub, and a gasket hermetically connects the supporting plate and the rear side of the tub, in which the gasket is formed as a bellows and has one side fixed to the rear side of the tub and another side fixed to an outer circumference surface of the supporting plate.

A supporting unit for supporting an assembly composed of the drum, the driving motor, and the supporting plate with buffering is installed between the supporting plate and the cabinet.

The supporting unit comprises: a plurality of upper supporting rods connected to an upper side of the supporting plate towards an orthogonal direction and having a predetermined length; buffering springs connected between the upper supporting rods and an upper inner wall of the cabinet for buffering; a plurality of lower supporting rods connected to a lower side of the supporting plate towards an orthogonal direction and having a predetermined length; and dampers connected between the lower supporting rods and a lower inner wall of the cabinet for absorbing vibration.

The drum is provided with a liquid balancer at a circumference of an inlet thereof for maintaining a balance when the drum is rotated.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
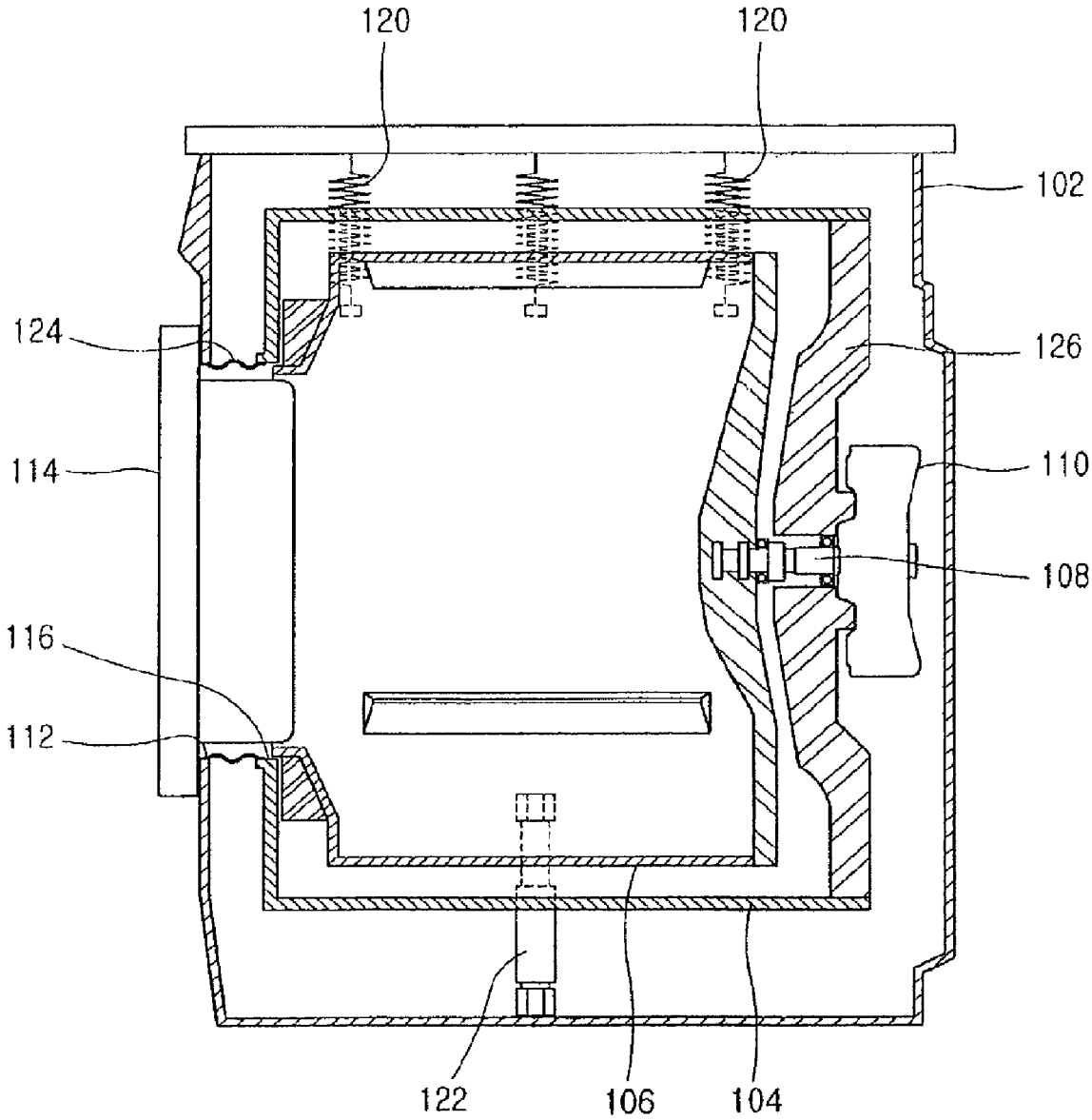
FIG. 1 CONVENTIONAL ART
FIG. 1 is a side sectional view showing a drum type washing machine in accordance with the conventional art.
Figure 2:
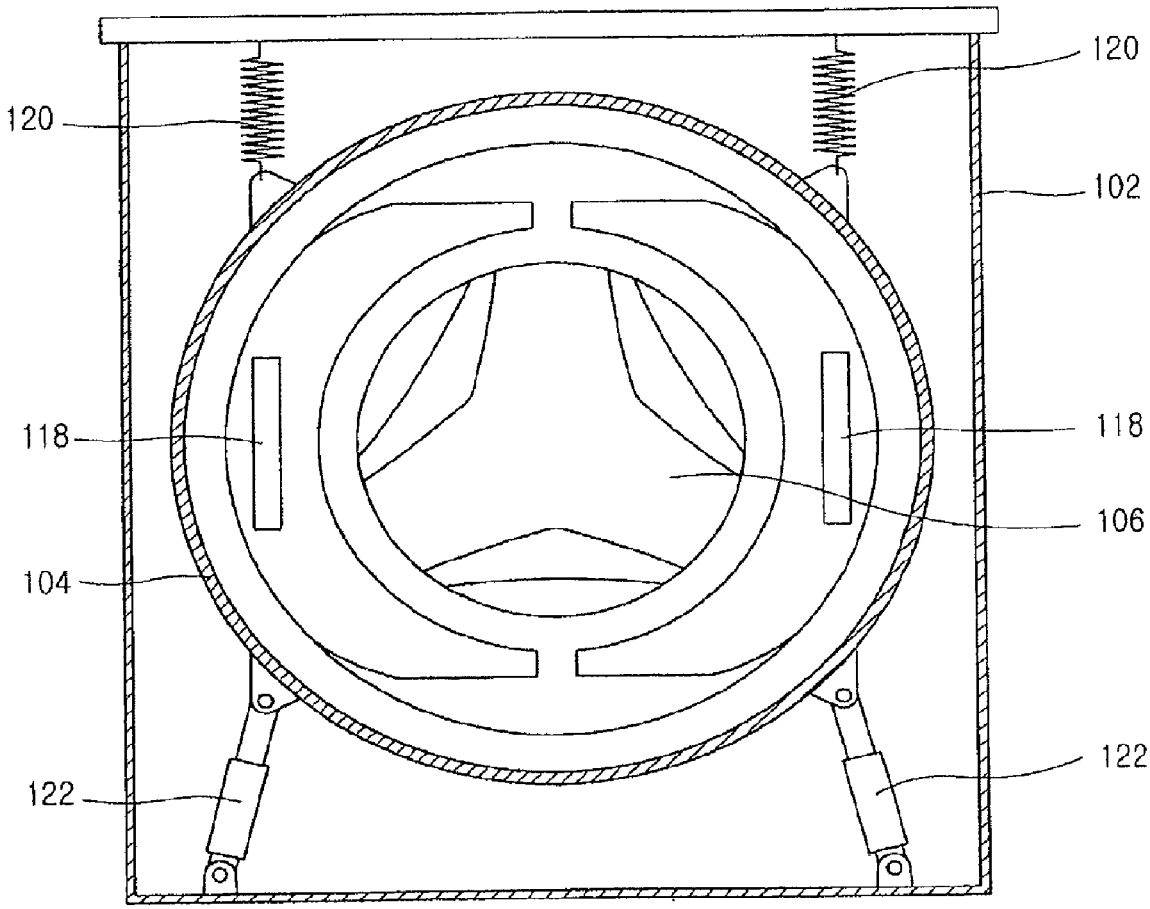
FIG. 2 CONVENTIONAL ART
FIG. 2 is a front sectional view showing the drum type washing machine in accordance with the conventional art.
Figure 3:
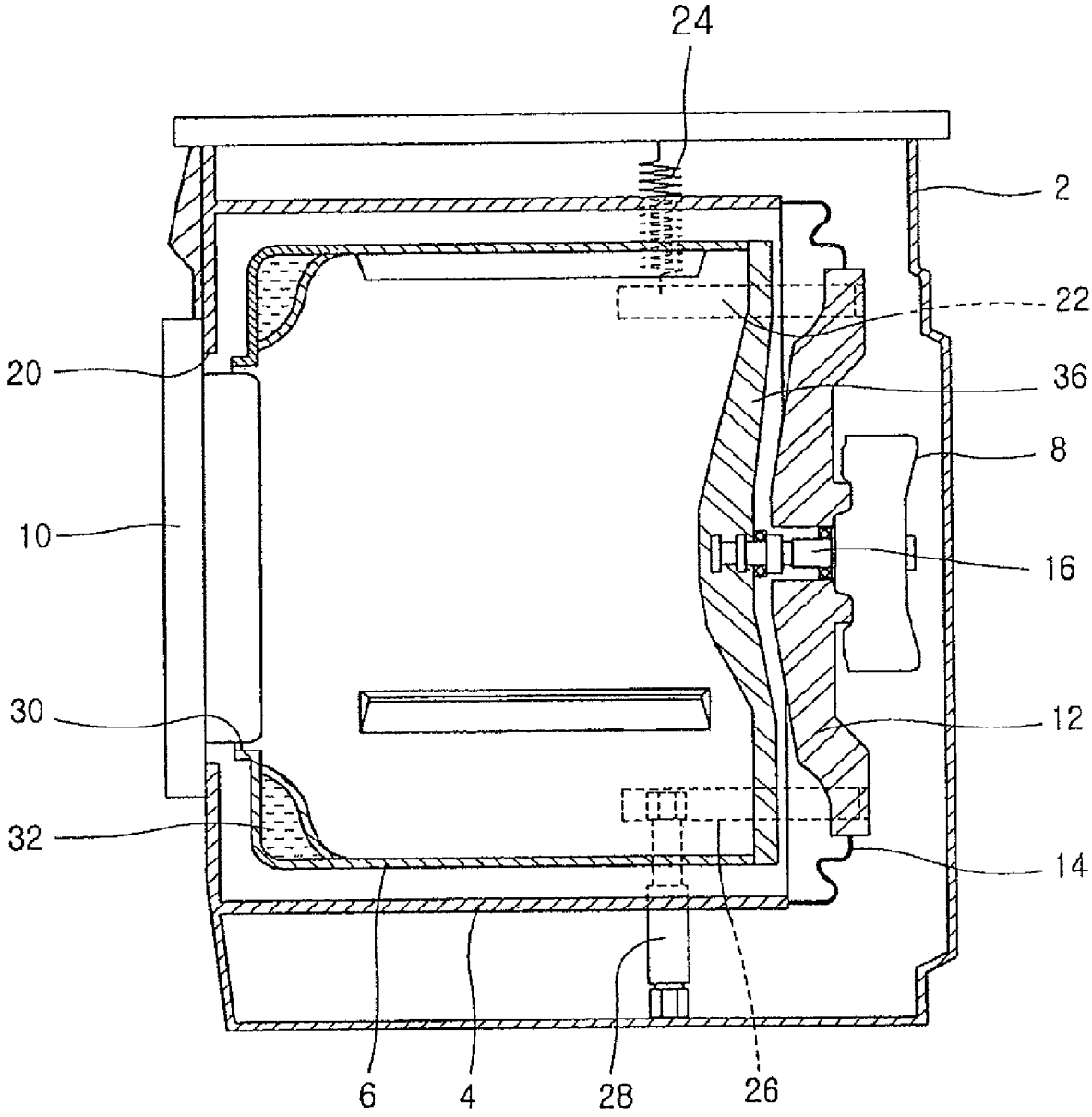
FIG. 3 is a side sectional view showing a drum type washing machine according to one embodiment of the present invention.
Figure 4:
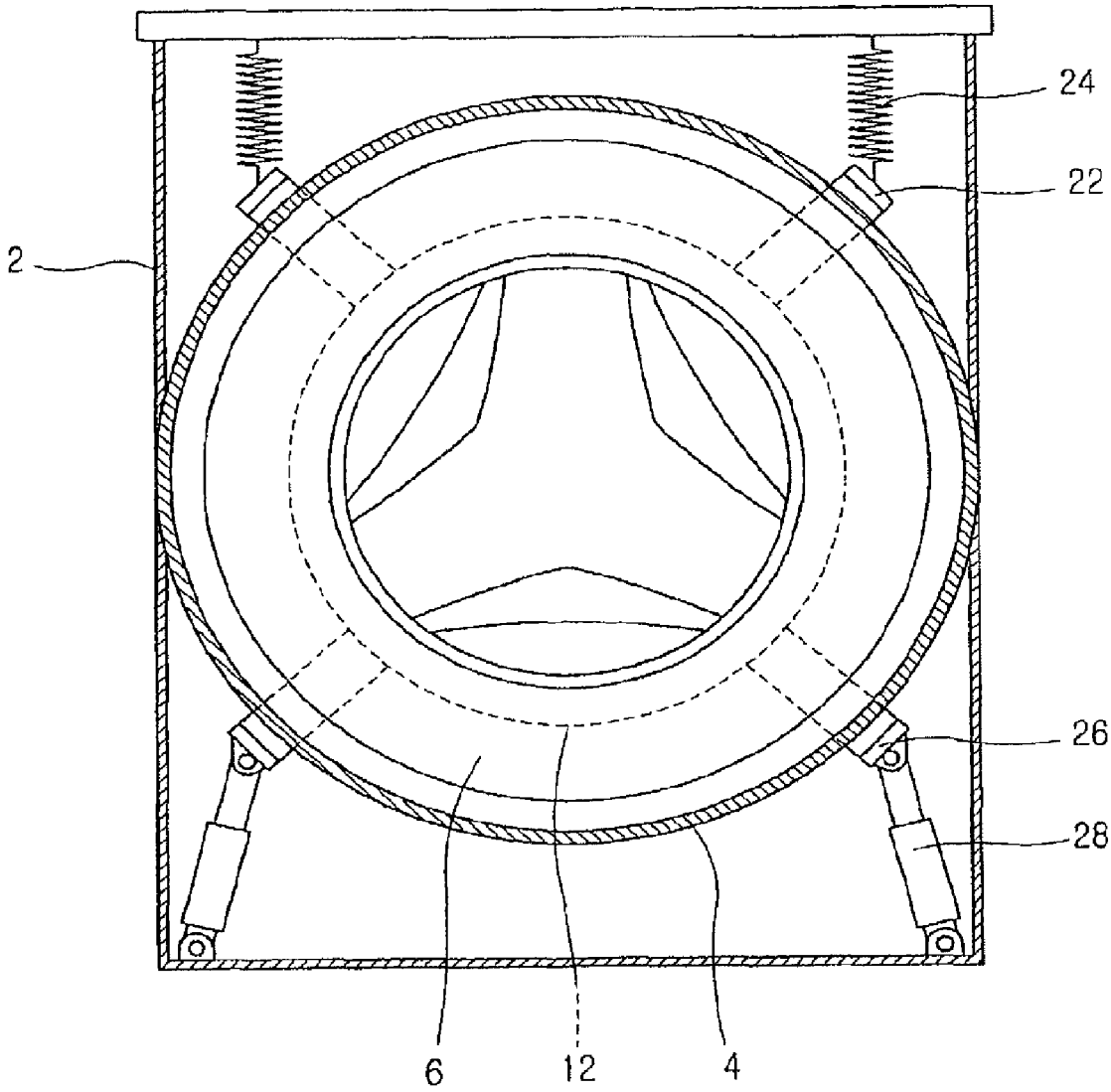
FIG. 4 is a front sectional view showing the drum type washing machine according to one embodiment of the present invention.
Figure 5:
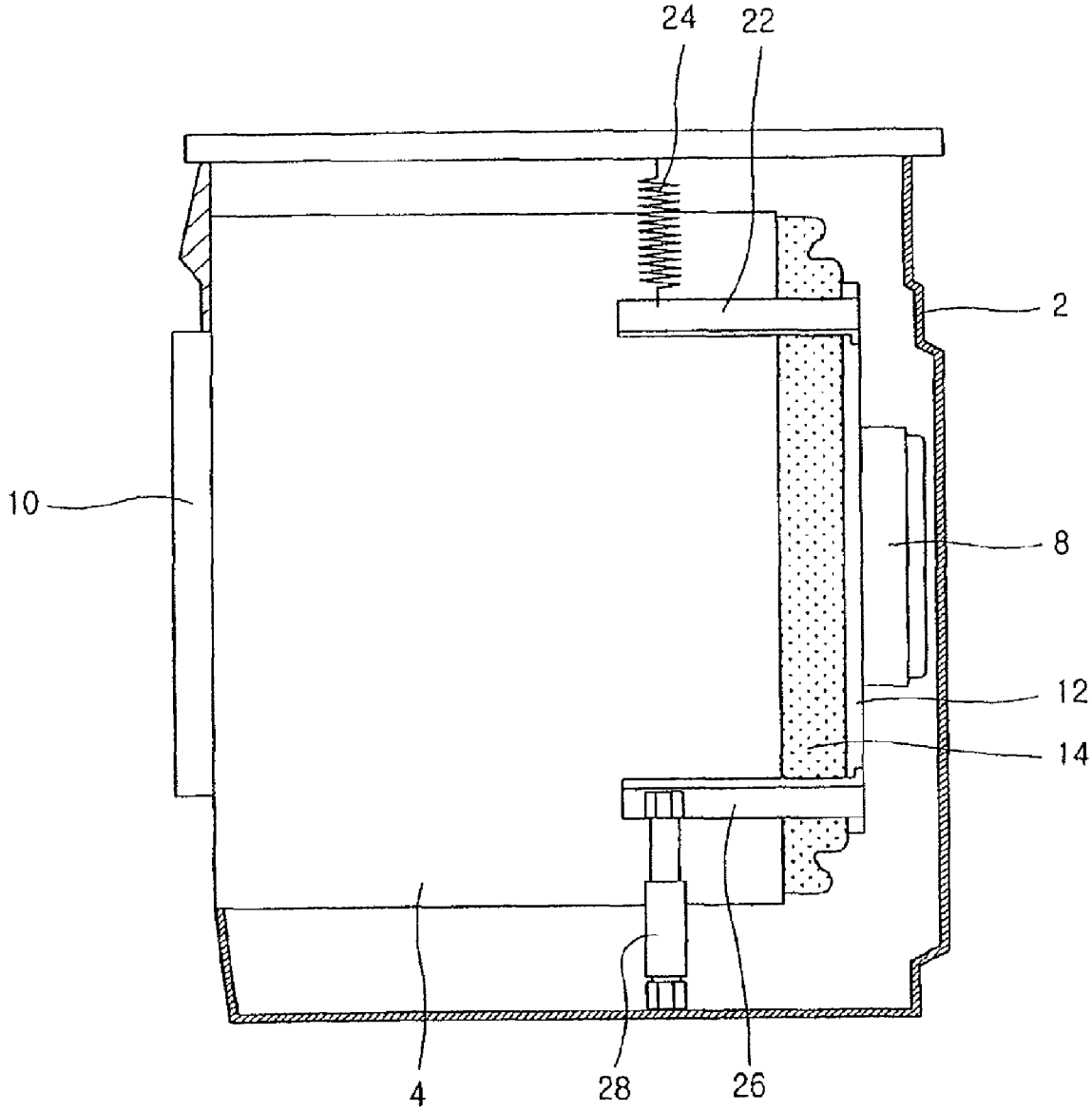
FIG. 5 is a lateral view showing a state that a casing of the drum type washing machine according to one embodiment of the present invention is cut.

FIG. 3 is a side sectional view showing a drum type washing machine according to one embodiment of the present invention, and FIG. 4 is a front sectional view showing the drum type washing machine according to one embodiment of the present invention.

The drum type washing machine according to one embodiment of the present invention comprises: a cabinet 2 for forming an appearance of a washing machine; a tub 4 formed integrally with the cabinet 2 and for storing washing water; a drum 6 rotatably arranged in the tub 4 for washing and dehydrating laundry; and a driving motor 8 positioned at the rear side of the drum 6 for generating a driving force by which the drum 6 is rotated.

The cabinet 2 is a rectangular parallelpiped, and an inlet 20 for inputting and outputting laundry is formed at the front side of the cabinet 2 and a door 10 for opening and closing the inlet 20 is formed at the inlet 20.

The tub 4 is formed as a cylinder shape having a predetermined diameter in the cabinet 2, and the front side of the tub 4 is fixed to the front inner wall of the cabinet 2 or integrally formed at the front inner wall of the cabinet 2. Both sides of the tub 4 are contacted to both sides inner wall of the cabinet 2 or integrally formed with both sides inner wall of the cabinet 2 thus to be prolonged.

Herein, since both sides of the tub 4 are contacted to both sides inner wall of the cabinet 2, a diameter of the tub 4 can be increased.

Also, the supporting plate 12 is positioned at the rear side of the tub 4 and the gasket 14 is installed between the supporting plate 12 and the rear side of the tub 4, thereby preventing washing water filled in the tub 4 from being leaked.

The gasket 14 is formed as a bellows of a cylinder shape and has one side fixed to the rear side of the tub 4 and another side fixed to an outer circumference surface of the supporting plate 12.

The supporting plate 12 is formed as a disc shape, the driving motor 8 is fixed to the rear surface thereof, and a rotation shaft 16 for transmitting a rotation force of the driving motor 8 to the drum 6 is rotatably supported by the supporting plate 12. Also, a supporting unit for supporting the drum 6 with buffering is installed between the supporting plate 12 and the inner wall of the cabinet 2.

The supporting unit comprises: a plurality of upper supporting rods 22 connected to an upper side of the supporting plate 12 and having a predetermined length; buffering springs 24 connected between the upper supporting rods 22 and an upper inner wall of the cabinet 2 for buffering; a plurality of lower supporting rods 26 connected to a lower side of the supporting plate 12 and having a predetermined length; and dampers 28 connected between the lower supporting rods 26 and a lower inner wall of the cabinet 2 for absorbing vibration.

Herein, the buffering springs 24 and the dampers 28 are installed at a center of gravity of an assembly composed of the drum 6, the supporting plate 12, and the driving motor 8. That is, the upper and lower supporting rods 22 and 26 are prolonged from the supporting plate 12 to the center of gravity of the assembly, the buffering springs 24 are connected between an end portion of the upper supporting rod 22 and the upper inner wall of the cabinet 2, and the dampers 28 are connected between an end portion of the lower supporting rod 26 and the lower inner wall of the cabinet 2, thereby supporting the drum 6 at the center of gravity.

A diameter of the drum 6 is installed in a range that the drum 6 is not contacted to the tub 4 even when the drum 6 generates maximum vibration in order to prevent interference with the tub 4 at the time of being rotated in the tub 4.

Operations of the drum type washing machine according to the present invention are as follows.

If the laundry is inputted into the drum 6 and a power switch is turned on, washing water is introduced into the tub 6. At this time, the front side of the tub 6 is fixed to the cabinet 2 and the gasket 14 is connected between the rear side of the tub 6 and the supporting plate 12, thereby preventing the washing water introduced into the tub 6 from being leaked outwardly.

If the introduction of the washing water is completed, the driving motor 8 mounted at the rear side of the supporting plate 12 is driven, and the drum 6 connected with the driving motor 8 by the rotation shaft 16 is rotated, thereby performing washing and dehydration operations. At this time, the assembly composed of the drum 6, the driving motor, and the supporting plate 12 is supported by the buffering springs 24 and the dampers 28 mounted between the supporting plate 12 and the inner wall of the cabinet 20.

Figure 6:
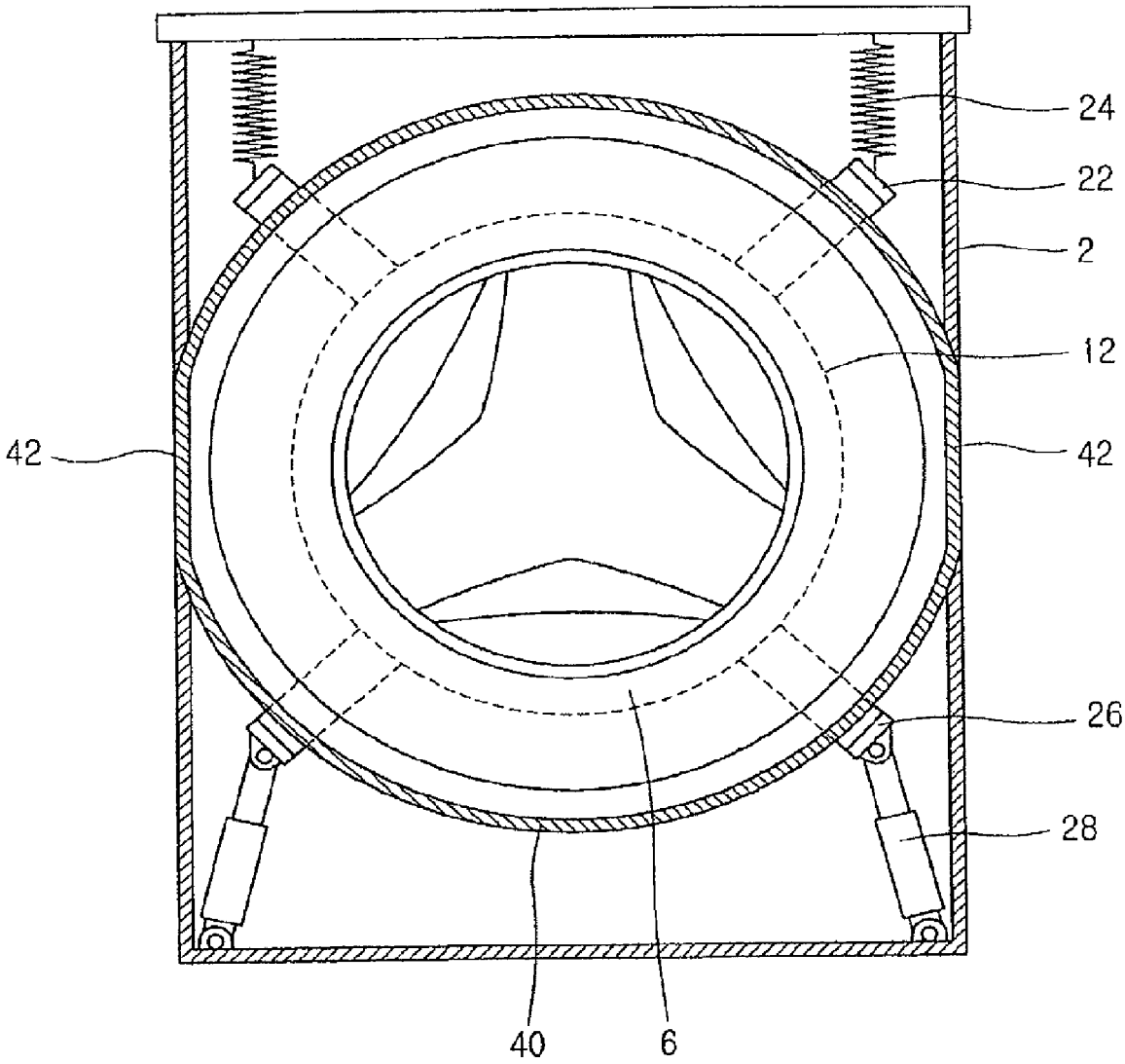
FIG. 6 is a front sectional view of a drum type washing machine according to a second embodiment of the present invention.

FIG. 6 is a front sectional view of a drum type washing machine according to a second embodiment of the present invention.

The drum type washing machine according to the second embodiment of the present invention has the same construction and operation as that of the first to embodiment except a shape of the tub.

That is, the tub 40 according to the second embodiment has a straight line portion 42 with a predetermined length at both sides thereof. The straight line portion 42 is fixed to the inner wall of both sides of the cabinet 2, or integrally formed at the wall surface of both sides of the cabinet 2.

Like this, since the tub 40 according to the second embodiment has both sides fixed to the cabinet 2 as a straight line form, the diameter of the tub 40 can be increased. Accordingly, the diameter of the drum 6 arranged in the tub 40 can be more increased.

Figure 7:
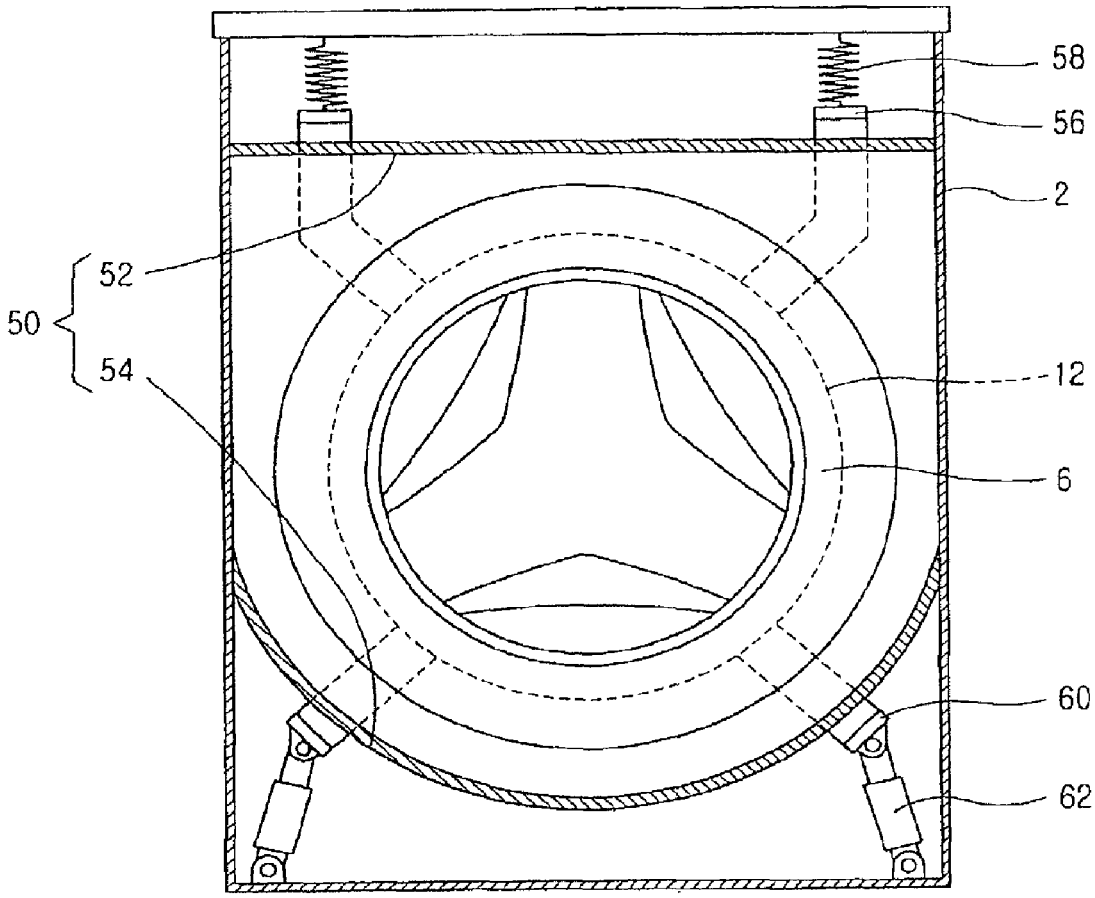
FIG. 7 is a front sectional view showing a drum type washing machine according to a third embodiment of the present invention.
Figure 8:
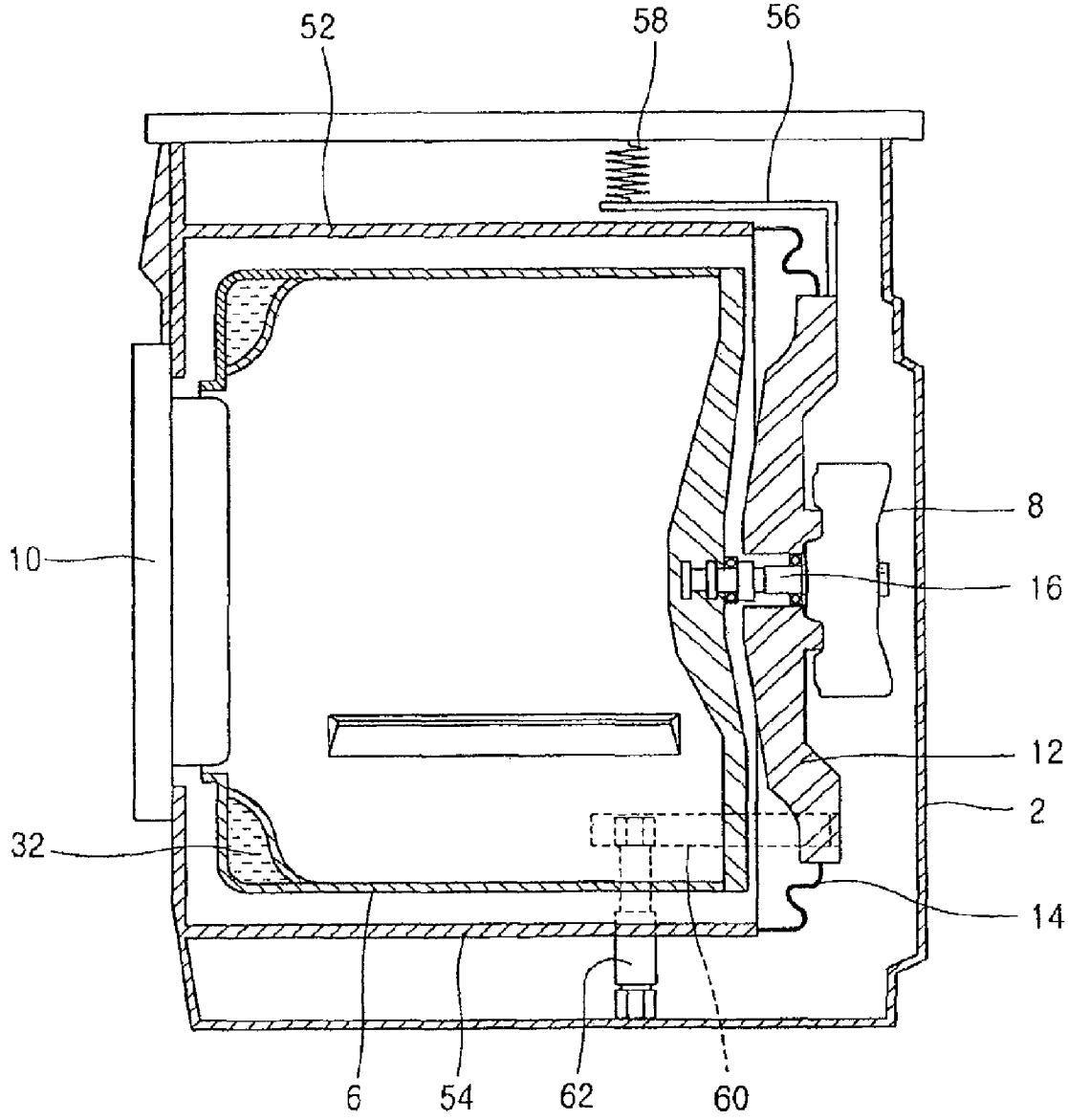
FIG. 8 is a longitudinal sectional view of the drum type washing machine according to the third embodiment of the present invention.
Figure 9:
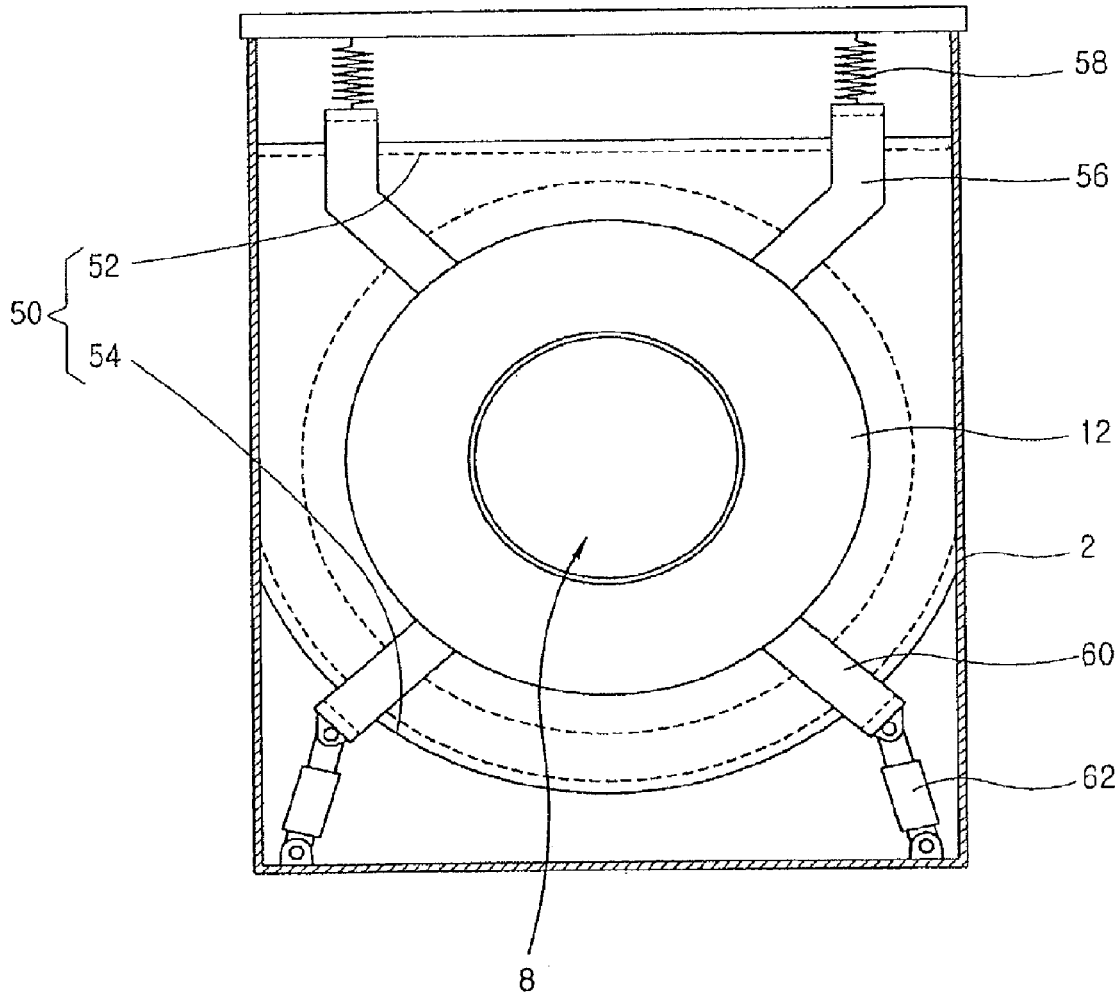
FIG. 9 is a rear sectional view showing the drum type washing machine according to the third embodiment of the present invention.

FIG. 7 is a front sectional view showing a drum type washing machine according to a third embodiment of the present invention, FIG. 8 is a longitudinal sectional view of the drum type washing machine according to the third embodiment of the present invention, and FIG. 9 is a rear sectional view showing the drum type washing machine according to the third embodiment of the present invention.

The drum type washing machine according to the third embodiment of the present invention comprises: a cabinet 2 for forming an appearance of a washing machine; a tub 50 formed integrally with the cabinet 2 and for storing washing water; a drum 6 rotatably arranged in the tub 50 for washing and dehydrating laundry; and a supporting unit positioned at the rear side of the tub 50 and arranged between the supporting plate 12 to which the driving motor 8 is fixed and the cabinet 2 for supporting the drum 6 with buffering.

The tub 50 is composed of a first partition wall 52 fixed to the upper front inner wall and both sides inner wall of the cabinet 2; and a second partition wall 54 integrally fixed to the lower front inner wall and both sides inner wall of the cabinet 2.

The first partition wall 52 of a flat plate shape is formed at the upper side of the cabinet 2 in a state that the front side and both sides are integrally formed at the inner wall of the cabinet 2 or fixed thereto. Also, the second partition wall 54 of a semi-circle shape is formed at the lower side of the cabinet 2 in a state that the front side and both sides are integrally formed at the inner wall of the cabinet 2 or fixed thereto.

The supporting unit comprises: a plurality of upper supporting rods 56 connected to the upper side of the supporting plate 12 and having a predetermined length; buffering springs 58 connected between the upper supporting rods 56 and the upper inner wall of the cabinet 2 for buffering; a plurality of lower supporting rods 60 connected to the lower side of the supporting plate 12 and having a predetermined length; and dampers 62 connected between the lower supporting rods 60 and the lower inner wall of the cabinet 2 for absorbing vibration.

Herein, the upper supporting rods 56 are bent to be connected to the upper side of the supporting plate 12 and positioned at the upper side of the first partition wall 52, and the buffering springs 58 are connected to the end portion of the upper supporting rods 56. Also, the lower supporting rods 60 are bent to be connected to the lower side of the supporting plate 12 and positioned at the lower side of the second partition wall 54, and the dampers 62 are connected to the end portion of the lower supporting rods 56.

In the drum type washing machine according to the present invention, a size of the drum can be maximized by fixing the tub in the cabinet, thereby increasing washing capacity of the drum without increasing a size of the cabinet.

Also, since the front surface of the tub is integrally formed at the inner wall of the cabinet and the gasket is installed between the rear surface of the tub and the supporting plate, a length of the drum can be increased and thus the washing capacity of the drum can be increased.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A laundry machine, comprising:
a tub to hold water therein;
a drum rotatably arranged in the tub;
a driving assembly, including:
a rotational shaft connected to the drum;
a supporting plate to rotatably support the rotational shaft; and
a motor to rotate the rotational shaft;
a flexible material to prevent the water inside the tub from leaking toward the driving assembly and to allow the driving assembly to move relative to the tub, wherein a portion at which the flexible material is connected to the supporting plate is spaced farther from the drum than a center portion of the supporting plate, the flexible material including:
a tub-connecting portion connected to the tub;
a driving-assembly-connecting portion connected to the driving assembly; and
a flexible curved portion which is flexibly extendible in a radial direction between the tub-connecting portion and the driving-assembly-connecting portion; and
a supporting unit to reduce vibration of the drum.

2. The laundry machine of claim 1, wherein the flexible material includes a straight portion.

3. The laundry machine of claim 2, wherein the straight portion is not curved, and is inclined with respect to an axis normal to a rotational axis of the rotational shaft.

4. The laundry machine of claim 3, wherein the straight portion is located radially inside the flexible curved portion.

5. The laundry machine of claim 2, wherein the straight portion is normal to the rotational axis.

6. The laundry machine of claim 1, wherein the flexible material includes straight portions arranged radially inside and outside the flexible curved portion.

7. The laundry machine of claim 1, wherein the flexible curved portion has less than three inflection points.

8. The laundry machine of claim 1, wherein the flexible material has less than or equal to three turnings with respect to a rotational axis direction of the shaft.

9. The laundry machine of claim 1, wherein the flexible material has less than or equal to two surfaces which a straight line connecting connection points of the flexible material to the tub and the driving assembly crosses.

10. The laundry machine of claim 1, wherein an outer diameter of the flexible material is larger than a diameter of the drum.

11. The laundry machine of claim 1, wherein the motor is co-axially connected to the rotational shaft.

12. The laundry machine of claim 11, wherein the supporting plate includes a shaft-supporting portion at which the shaft is rotatably supported and an extended portion extending in a radial direction from the shaft-supporting portion, and wherein the flexible material is connected to the extended portion.

13. The laundry machine of claim 1, wherein the supporting unit is attached to the driving assembly.

14. The laundry machine of claim 1, wherein the tub is supported more rigidly than the drum is supported.

15. A laundry machine, comprising:

a tub to hold water therein;

a drum rotatabled in the tub;

a driving assembly, including:

a rotational shaft connected to the drum;

a supporting plate to rotatably support the rotational shaft; and a motor to rotate the rotational shaft;

a flexible material to prevent the water inside the tub from leaking toward the driving assembly and to allow the driving assembly to move relative to the tub, the flexible material including:

a tub-connecting portion connected to the tub;

a driving-assembly-connecting portion connected to the driving assembly; and a flexible curved portion which is flexibly extendible in a radial direction between the tub-connecting portion and the driving-assembly-connecting portion, wherein a larger portion of the flexible curved portion is arranged outside the tub than inside the tub; and a supporting unit to reduce vibration of the drum.

16. A laundry machine, comprising:

a tub to hold water therein;

a drum rotatably arranged in the tub;

a driving assembly, including:

a rotational shaft connected to the drum;

a supporting plate to rotatably support the rotational shaft, wherein a drum-facing surface of the supporting plate is spaced farther from the drum at a radially outer portion thereof than at a center portion thereof; and a motor to rotate the rotational shaft;

a flexible material to prevent the water inside the tub from leaking toward the driving assembly and to allow the driving assembly to move relative to the tub, the flexible material including:

a tub-connecting portion connected to the tub;

a driving-assembly-connecting portion connected to the driving assembly; and a flexible curved portion which is flexibly extendible in a radial direction between the tub-connecting portion and the driving-assembly-connecting portion; and a supporting unit to reduce vibration of the drum.

17. A laundry machine, comprising:

a tub to hold water therein;

a drum rotatably arranged in the tub;

a driving assembly, including:

a rotational shaft connected to the drum;

a supporting plate to rotatably support the rotational shaft, wherein the supporting plate includes a shaft-supporting portion at which the shaft is rotatably supported and an extended portion extending in a radial direction from the shaft-supported portion; and a motor to rotate the rotational shaft;

a flexible material to prevent he water inside the tub from leaking toward the driving assembly and to allow the driving assembly to move relative to the tub, wherein the flexible material is connected to the extended portion of the supporting plate, and wherein a drum-facing surface of the extended portion is inclined in a radially outward direction, the flexible material including;

a tub-connecting portion connected to the tub:

a driving-assembly-connecting portion connected to the driving assembly; and a flexible curved portion which is flexibly extendible in a radial direction between the tub-connecting portion and the driving-assembly-connecting portion; and a supporting unit to reduce vibration of the drum.

18. The laundry machine of claim 17, wherein the extended portion includes a circumferential surface at a radially outer portion and the flexible material is connected at the circumferential surface.

19. The laundry machine of claim 18, wherein the extended portion includes a recessed surface at a side opposite to the drum-facing surface, the recessed surface being recessed toward the drum to provide a space for the motor.

20. A laundry machine, comprising:

a tub to hold water therein;

a drum rotatably arranged in the tub;

a driving assembly, including:

a rotational shaft connected to the drum;

a supporting plate to rotatably support the rotational shaft, wherein the supporting plate includes a shaft-supporting portion at which the shaft is rotatably supported and an extended portion extending in a radial direction from the shaft-supporting portion, and wherein the extended portion is bent at a radially outer portion in a direction opposite to the drum and the motor is mounted to the supporting plate radially inside the bent portion; and a motor to rotate the rotational shaft;

a flexible material to prevent the water inside the tub from leaking toward the driving assembly and to allow the driving assembly to move relative to the tub, wherein the flexible material is connected to the extended portion, the flexible material including:

a tub-connecting portion connected to the tub;

a driving-assembly-connecting portion connected to the driving assembly; and a flexible curved portion which is flexibly extendible in a radial direction between the tub-connecting onion and the driving-assembly-connecting portion; and a supporting unit to reduce vibration of the drum.

21. A laundry machine, comprising:

a tub to hold water therein;

a drum rotatably arranged in the tub;

a driving assembly, including:

a rotational shaft connected to the drum;

a supporting plate to rotatably support the rotational shaft; and a motor to rotate the rotational shaft, wherein the motor is co-axially connected to the rotational shaft, and wherein the supporting plate includes a shaft-supporting portion at which the shaft is rotatably supported and an extended portion extending in a radial direction from the shaft-supporting portion;

a flexible material to prevent the water inside the tub from leaking toward the driving assembly and to allow the driving assembly to move relative to the tub, wherein the flexible material is connected to the extended portion of the supporting plate at a portion which is located radially outside the motor; and a supporting unit to reduce vibration of the drum.

* * * * *